US005358742A

United States Patent [19]

Ziff

[11] Patent Number: 5,358,742

[45] Date of Patent: Oct. 25, 1994

[54] PROCESS FOR PROVIDING A VISUALLY DISTINCTIVE TARGET BY COLORING AND HEAT DEFORMATION OF HOOK MATERIAL ON THE TARGET

[76] Inventor: Irving Ziff, 27603 Saddle Rd., Rolling Hills, Estates, Calif. 90274

[21] Appl. No.: 133,524

[22] Filed: Oct. 7, 1993

[51] Int. Cl.[5] ..... B05D 5/06

[52] U.S. Cl. ..... 427/276; 273/346; 264/137; 264/222

[58] Field of Search ..... 427/271, 275, 276, 277, 427/278; 273/346, DIG. 30; 264/129, 136, 296, 322, 137

[56] References Cited

U.S. PATENT DOCUMENTS

| | | | |
|---|---|---|---|
| 3,560,321 | 2/1991 | Magid | 427/275 |
| 3,857,566 | 12/1974 | Lemelson et al. | 273/346 |
| 3,927,881 | 12/1975 | Lemelson et al. | 273/58 K |
| 4,415,154 | 11/1983 | Engelhardt | 273/60 R |
| 4,734,298 | 3/1988 | Kikukawa | 427/256 |

FOREIGN PATENT DOCUMENTS

| | | | |
|---|---|---|---|
| 2603410 | 8/1977 | Fed. Rep. of Germany | 427/277 |
| 63-17945 | 4/1988 | Japan | 264/296 |
| 993254 | 5/1965 | United Kingdom | 273/346 |

OTHER PUBLICATIONS

"Velcro Fasteners Score High in Fun & Games", Playthings, Jan. 1977, p. 13.

*Primary Examiner*—Terry J. Owens
*Attorney, Agent, or Firm*—Albert M. Herzig

[57] ABSTRACT

A game apparatus has a panel with a target area supported on a frame against which a ball is aimed and tossed. The ball covering and the target area include hook and pile fastener materials so that the ball will releasably attach to the target area upon impact. The target area employs hook material while the ball covering includes the pile material. A graphic representation of a target is formed on the target area by applying pigmented ink to selected portions of the hooks and by employing a heat sublimation process to deform selected portions of the hooks along with the pigmented ink to display a particular target representation. The frame may be placed on the ground or may be floated by using buoyant spheres or bulbs secured to the frame.

3 Claims, 2 Drawing Sheets

PROCESS FOR PROVIDING A VISUALLY DISTINCTIVE TARGET BY COLORING AND HEAT DEFORMATION OF HOOK MATERIAL ON THE TARGET

BACKGROUND OF THE INVENTION

1. Field of the Invention

This invention relates to the field of games, and more particularly to a novel game apparatus which involves the tossing of a ball at a target whereby the ball releasably adheres to the target upon impact and which target may be either supported on the ground or may be floated on the surface of a pool or the like.

2. Brief Description of the Prior Art

In the past, it has been the conventional practice to employ a target at which a ball is tossed in order to provide entertainment for the participants in the form of amusement, increasing physical skill and for game purposes such as accumulating a score. Usually, the tossed ball will bounce off of the target upon impact and means are sometimes employed for collecting the ball after its force has been spent upon impact with the target. In other instances, missiles, such as darts, will remain attached to the target, such as when a pointed tip of the dart penetrates the target area sufficiently to support the missile. Also, problems and difficulties have been encountered when constructing the target area so as to display a target in a particular representation so that it is not only visible to the participants of the game but will not become worn or separated from the target upon impact of the ball. Care must be taken that the graphic representation of the target remain on its support and not become dislodged or separated from the support upon impact.

Therefore, a long-standing need has existed to provide a novel game apparatus incorporating a ball and target capable of releasably retaining and securing the ball to the target upon impact after being tossed by a game participant. Securement of the target graphic representation is important so that it is not separated from its carrier after such impact. The apparatus is designed for use either on solid ground, poolside or actually floatable in a body of water, such as a pool per se.

SUMMARY OF THE INVENTION

Accordingly, the above problems and difficulties are avoided by the present invention which provides a panel carrying a target area which is intended to receive a tossed ball during the procedure of a game wherein the ball is releasably retained on the target area after the toss by the participant. The target area and the ball covering include a hook and pile fastening means in order to effect the releasable retention and the target area includes a graphic representation intended to be aimed at by the participant which will not separate from the panel on which it is carried and which is intended to last for a considerable period of time. In one form, the panel is supported on a frame which is in the shape of an inverted V inside elevation and which carries a support for engagement with solid ground or may further include buoyant means for supporting the frame on a body of water.

Therefore, it is among the primary objects of the present invention to provide a novel game apparatus wherein a ball and target area include a hook and pile fastening means intended to releasably secure the ball to the target area upon impact after being tossed by a game participant.

Another object of the present invention is to provide a novel means for displaying a target representation on the target panel so that it will not become dislodged or removed upon impact by the ball after being tossed by the participant.

Still a further object of the present invention is to provide a novel game apparatus which may be supported on the surface of a body of water and which provides excitement and action for the game participants.

Still a further object of the present invention is to provide a novel target game apparatus that includes a target area incorporating means for detachably receiving and holding a game ball upon impact therewith so that the relationship of the ball and the target representation is maintained after a plurality of balls have been tossed.

A further object of the present invention is to provide a game apparatus which provides a dual float support for maintaining a target stability on the surface of a body of water and which employs a hook and pile or loop fastener system which assures positive ball grip on the target surface even when the balls are soaked with water.

A further object resides in providing a target area and representation on a mesh backing for ease in retrieval.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
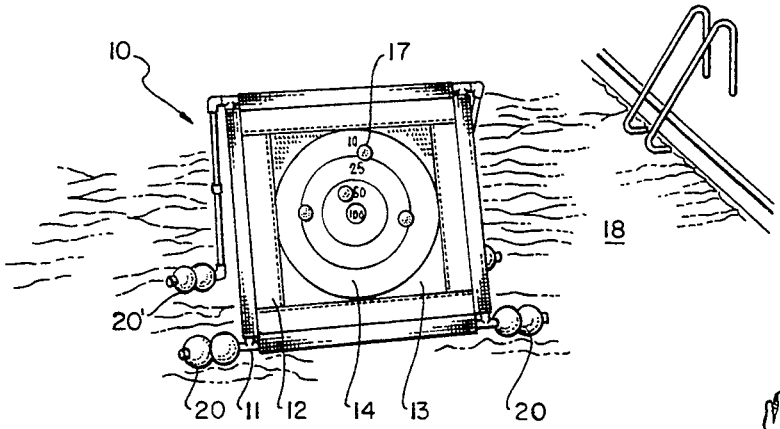
FIG. 1 is a reduced front perspective view of the game apparatus incorporating the present invention illustrated as being supported on the surface of a body of water such as a pool.

Referring to FIG. 1, the novel game apparatus of the present invention is illustrated in the general direction of arrow 10 which includes a frame means broadly indicated by numeral 11 which supports a panel 12 on which a target area 13 is carried. The target area 13 includes a graphic representation of a target and in the present instance, the target is a plurality of concentric circles broadly illustrated by the numeral 14. Participants 15 and 16 are illustrated as being in the process of playing a game in which several balls, such as ball 17, are thrown or tossed from the participant directly at the target 14 on the target area 13. A major feature of the game apparatus resides in the adhesion of the ball with the surface of the target area 13 upon impact. Such securement or attachment is releasable so that at the conclusion of a course of play, the balls may be removed from their temporary attachment to the target area 13 and taken back to a starting area which is at a prescribed distance from the target.

Another feature of the game apparatus resides in the fact that the frame 11 may be supported on the ground, at the edge of a swimming pool or patio area, or may be floated on the surface of a body of water, such as a swimming pool which is broadly indicated by numeral 18. As illustrated, the plurality of ball 17 are shown as being attached to the target area by means which will be described later and the game apparatus is floating on the surface of the water 18 by means of buoyant spheres or bulbs, such as indicated by numeral 20, that are carried on the extremities of the frame 11.

Figure 2:
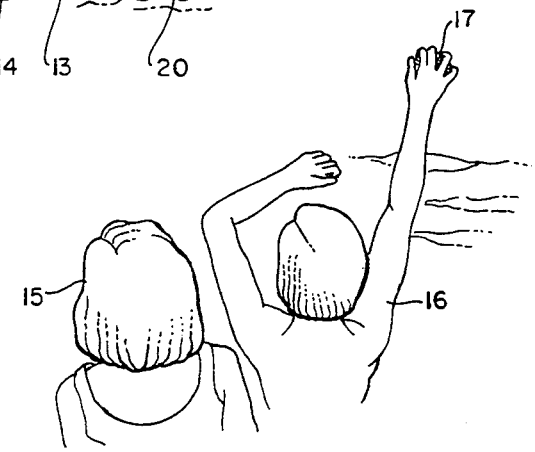
FIG. 2 is an enlarged front elevational view of the game apparatus shown in FIG. 1.
Figure 2:
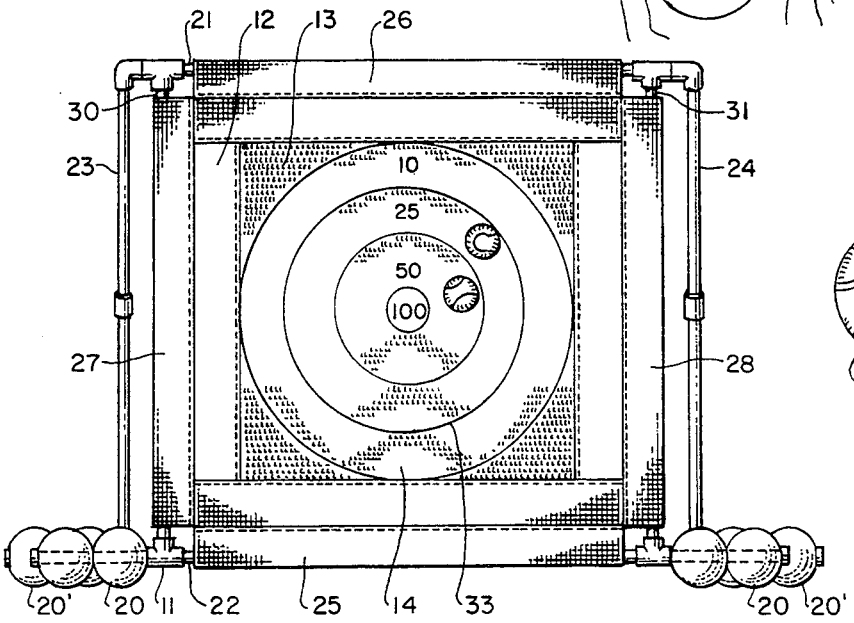

Referring now in detail to FIG. 2, it can be seen that the frame 11 includes an upper rod 21 and a lower rod 22 which are joined together at their opposite ends by lateral rods 23 and 24 respectively. The panel 12 is composed of a mesh material and is attached at its bottom and top by loops 25 and 26 formed by folding over the material of the panel and joining the edge marginal region by stitching so that the respective rods may be passed through the loops thus provided. In a similar fashion, the edge marginal regions along the lateral sides of panel 12 are folded over upon themselves to provide loops 27 and 28 so that intermediate rods 30 and 31 may be passed therethrough. By properly spacing the rods apart, the material of the panel 12 is suitably stretched so as to be taut and flat. A feature of the invention resides in providing the frame from tube structure composed of a plastic-like material so that it is light in weight and yet strong and serviceable. Intermediate connectors, such as elbows, T-sections and in-line couplings may be employed to join the segments together to form the frame. It is to be noted that the lower rod 22 is elongated at its opposite ends in order to accommodate mounting of the floats or buoyant bulbs 20.

With further reference to FIG. 2, it can be seen that the target area 13 carries a surface provided with a plurality of hooks forming a portion of a closure for a hook and pile fastening means. The pile is carried on the covering of the ball 17 so that upon impact, the hook and pile fastening means will engage and hold until released by a player in the game. The hook material or portion of the fastening means is carried on the panel 12, such as by sewing or stitching along adjacent edge marginal regions, and the target 14 is carried on the target area 13. The target per se is introduced to the hooks of the fastening means by applying a pigmented ink into the hooks utilizing a heat sublimation process. By employing heat and pressure, the desired graphic representation for the target may be impressed upon the hooks so that the hooks are deformed and caused to join together to provide the desired representation. It is preferred that during the process, a temperature of approximately 400 degrees Fahrenheit be employed and at a pressure of 60 psi with a dwell time within the range of 15 to 30 seconds. The temperature and psi can be changed or altered depending upon a variety of combinations to achieve the same results. In actual practice, for example, the graphic representation was formed on the hooks at 310 degrees Fahrenheit with 60–100 psi and a dwell time of 15 seconds. It was found that with the shorter dwell time, the hook portion in the fastening means was flattened and accepted the color transfer of the pigmented ink so that a variety of colors is added to the representation being displayed. At shorter interval, the color is not transferred to the backup sheet which is an integral part of the hook portion of the panel. With increased time and/or temperature, the gasses will spread the color laterally to the mesh panel.

Figure 6:
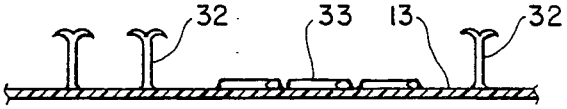
FIG. 6 is an enlarged cross-sectional view of the target panel illustrating the hooks of the hook and pile fastener means.

Referring now to FIG. 6, the formation of the graphic representation for the target is more clearly illustrated wherein the panel or target area is illustrated by numeral 13 and one surface facing the participants of the game is provided with a plurality of hooks, such as hook 32. It is to be understood that the full surface of the target area 13 comprises a plurality of hooks. Under heat and pressure, selected ones of the hooks are depressed so as to form a pattern following the outline of the desired graphic representation. The deformation of the hooks is illustrated by numeral 33 where the plurality of selected hooks are not only deformed but impregnated with a pigmented ink or other coloring. In effect, the material of the hooks is melted down with color transfer onto the surface.

Figure 3:
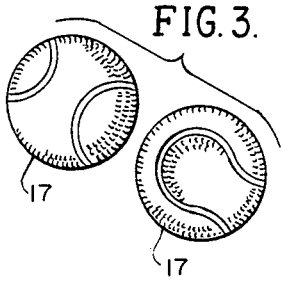
FIG. 3 is a perspective view illustrating a pair of balls intended to be tossed by participants during the course of play.

Referring now to FIG. 3, the ball 17 is illustrated which has a covering about its surface that includes a plurality of pile material or loops so that when contacted by the hooks 32, engagement occurs which will hold or releasably secure the ball to the target.

Figure 4:
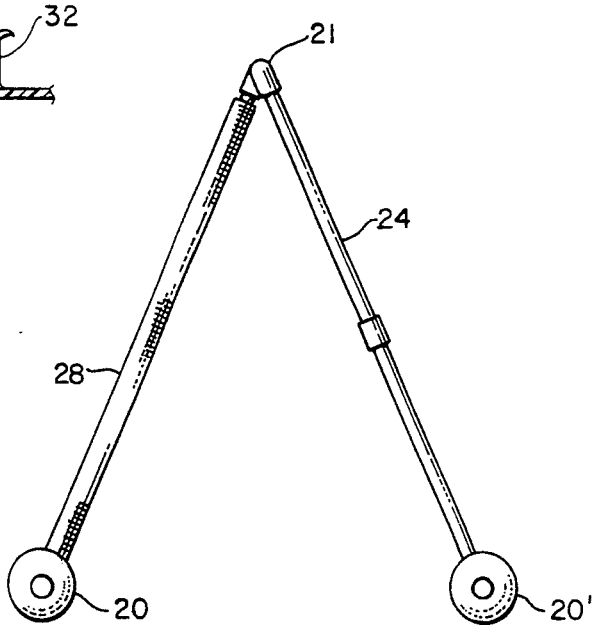
FIG. 4 is a side elevational view of the game apparatus shown in FIG. 2.
Figure 5:
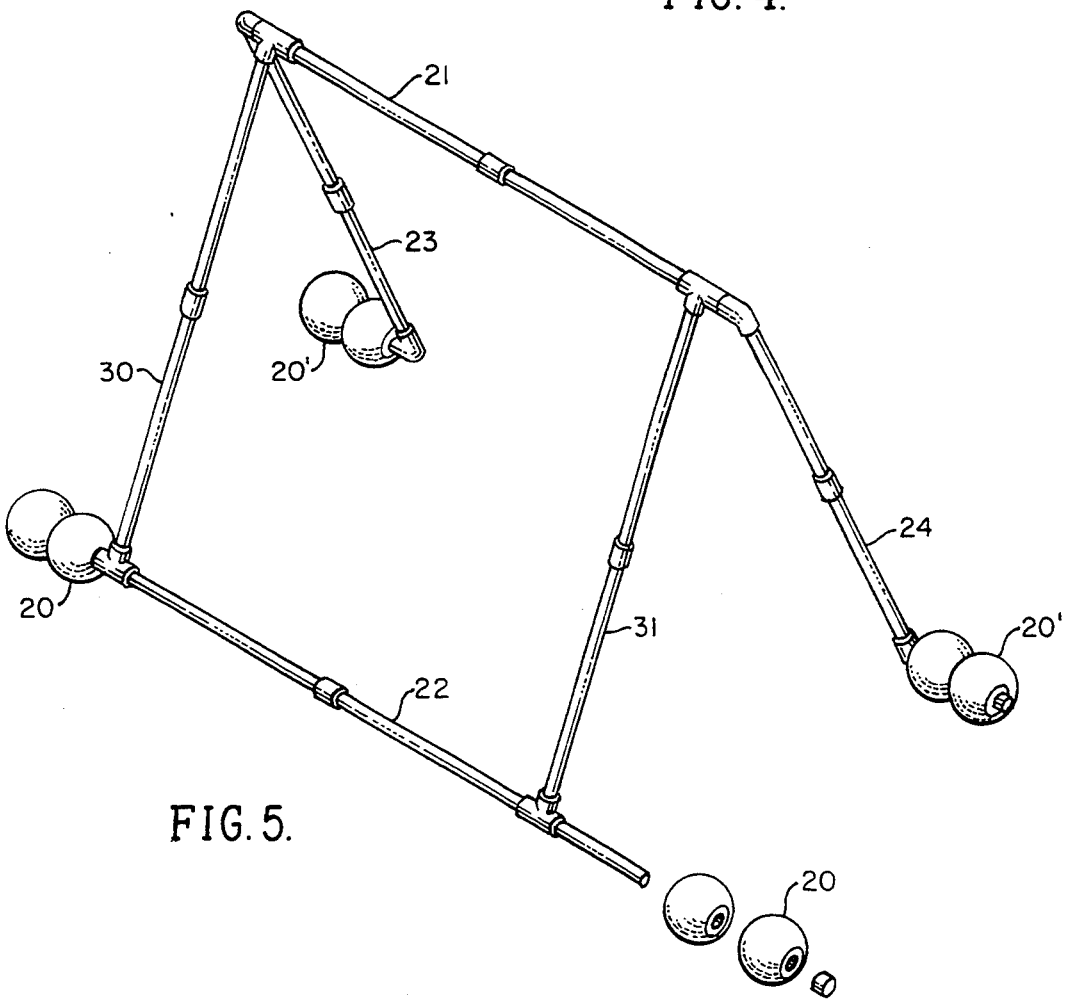
FIG. 5 is a front perspective view of the frame for supporting the target panel.

Referring now to FIGS. 4 and 5 in detail, it can be seen that the frame is in the shape of an inverted V in lateral or side elevational view and that the frame includes a rear support comprising rods 23 and 24. The intermediate rods 30 and 31 provide the forward support for the frame as well as for laterally mounting the panel 12 so that the target is displayed in the direction of the participants. Upper rod 21 is in common with the upper ends of rods 23 and 24 respectively and lower rod 22 is included with the forward support of the frame. The opposite ends of rod 22 serve to hold the floats 20 in position while the lower ends of rods 23 and 24 include short axles on which buoyant floats 20' are carried. It is clear from the showing in FIGS. 4 and 5 that the frame may be readily assembled or disassembled by using short rod segments that are joined by a variety of fittings. Thus, the frame may be readily manufactured and packaged in a box for transportation so that the end user may assemble at the use site.

In view of the foregoing, it can be seen that the game apparatus of the present invention provides a device which offers amusement and physical skill for the participants. The game is useful on land as well as on the surface of water and the balls are temporarily attached to the surface of the target upon impact. The balls may be readily removed from the target by the participants at the end of play. One type of hook and pile fastener that may be employed is known as VELCRO, although other types of hook and pile fastening means may be employed.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A process of providing a visually distinctive target of a given graphic representation comprising the steps of:

laying out a sheet of hook material having a multiplicity of raised hooks composed of heat sensitive material;

selecting a portion of said hooks intended to define the graphic representation;

applying heat to the selected portion of the hooks causing deformation to a sufficiently lower height than surrounding unselected hooks to form the graphic representation; and cooling the deformed hooks in ambient temperature.

2. The process as defined in claim 1 including the step of:

applying a coloring agent prior to said applying step to the selected portions of the hooks to impregnate coloring into the deformation for augmenting visual distinction from surrounding unselected hooks.

3. The process as defined in claim 2 wherein:

in said applying step, said selected portion of the hooks is heated to a temperature within the range of 300 degrees to 400 degrees Fahrenheit at a pressure within the range of 60 to 100 psi for a dwell time of 10 to 30 seconds.

* * * * *